United States Patent [19]

Kelley

[11] Patent Number: 4,960,014

[45] Date of Patent: Oct. 2, 1990

[54] EXTENSION HANDLE FOR WRENCHES

[76] Inventor: Roy C. Kelley, 7645 Laytonia Dr., Gaithersburg, Md. 20877

[21] Appl. No.: 409,331

[22] Filed: Sep. 19, 1989

[51] Int. Cl.[5] ..... B25G 1/04

[52] U.S. Cl. ..... 81/177.2; 294/19.1; 294/92

[58] Field of Search ..... 294/15, 18, 19.1, 92; 7/166, 167; 16/114 R, 115; 81/177.1, 177.2, 184, 185.2, 462, 489; 254/120, 121, 129–131

[56] References Cited

U.S. PATENT DOCUMENTS

| | | | |
|---|---|---|---|
| 1,463,077 | 7/1923 | Gandell | 81/177.2 |
| 1,511,738 | 10/1924 | Lownsbery | 81/177.2 |
| 1,643,027 | 9/1927 | Morgan | 81/177.2 |
| 2,184,921 | 12/1939 | Eggerss | 254/131 X |
| 2,342,068 | 2/1944 | White | 294/92 X |
| 2,490,739 | 12/1949 | Nesbitt | 294/92 X |
| 2,582,284 | 1/1952 | Sarosdy | 294/92 X |
| 3,122,354 | 2/1964 | Rodeback | 294/92 X |
| 4,104,935 | 8/1978 | Stoops | 81/177.2 |
| 4,644,600 | 2/1987 | Fugate | 81/177.2 X |

*Primary Examiner*—Johnny D. Cherry
*Attorney, Agent, or Firm*—William D. Hall

[57] ABSTRACT

An extension handle for a wrench is provided. The extension handle is elongated and has two U-shaped elements in planes perpendicular to the length of the extension handle. One of these U-shaped elements has its open and facing in one direction and the other U-shaped element has its open end facing in a direction opposite to the direction that the open end of the first element faces. This permits the extension handle to receive wrenches and to apply torque to the wrenches. In order that the extension handle will receive wrenches that are not flat, the U-shaped elements hold the wrenches in spaced relation to the body of the extension handle.

1 Claim, 1 Drawing Sheet

EXTENSION HANDLE FOR WRENCHES

BACKGROUND OF THE INVENTION

Mechanics have, for many years, extended the length of a wrench. One way that this has been done is to place a long pipe around one end of the wrench to increase the leverage of the wrench. Two patents have issued for handles having two oppositely positioned U-shaped members near one end of the handle, for receiving the wrench. With the wrench held by the two U-shaped members, the mechanic can greatly increase the leverage of the wrench. The two patents just referred to are Lownsbery U.S. Pat. No. 1,511,738, of Oct. 14, 1924, entitled: Extension Handle for Wrenches and Other Tools, and Fugate U.S. Pat. No. 4,644,600, of Feb. 24, 1987, entitled: Extension Handle for Wrenches.

SUMMARY OF THE INVENTION

As explained above, prior patents have taught an extension for wrenches having two U-shaped elements for holding the wrench. To be effective the space between the two legs of the U-shaped elements should be only a small amount greater than the thickness of the wrench, thus avoiding excessive "play" between the wrench and the U-shaped member. If slack or play between the wrench and the U-shaped element is avoided by a reasonably close fit, the extension members of the prior art will not accept some curved wrenches.

My invention spaces the U-shaped elements above the surface of the extension member. This permits the extension member to make a snug fit with a curved wrench.

DETAILED DESCRIPTION OF THE INVENTION

Figure 1:
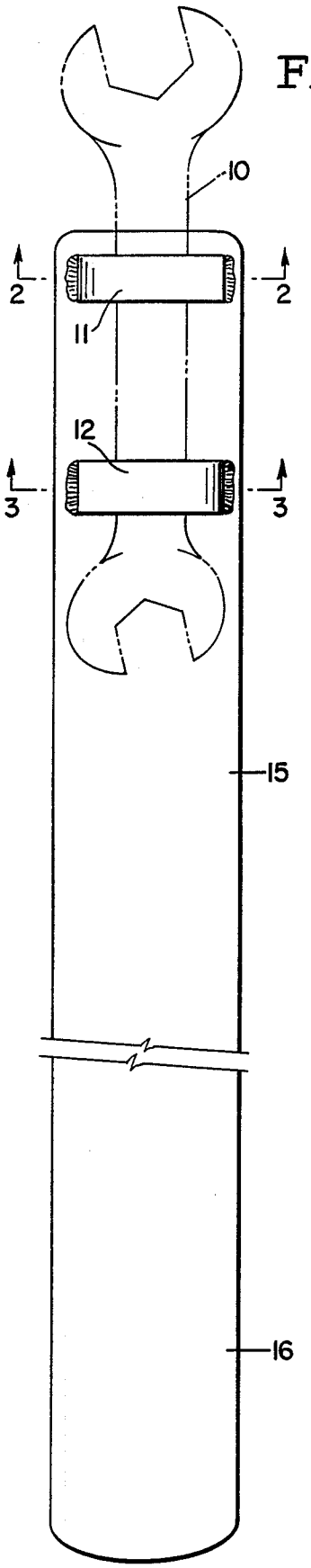
FIG. 1 is a top view of my invention.

In FIG. 1 a standard wrench 10 is shown in dashed lines. My extension constitutes a thick steel strip 15 having a handle 16 at one end and wrench holders 11 and 12 near the other end. The wrench holders 11 and 12 are curved members of U-shape, welded along one leg of the U to the strip 15. Each of U-shaped members 11 and 12 has an open end, and these open ends face in opposite directions; in other words, the open end of U-shaped member 11 is on the right side (assuming that the U-shaped member 11 is viewed from the top as in FIG. 1), as shown in FIG. 2, and similarly the U-shaped member 12 has its open end on the left hand side as shown in FIG. 3.

Figure 4:
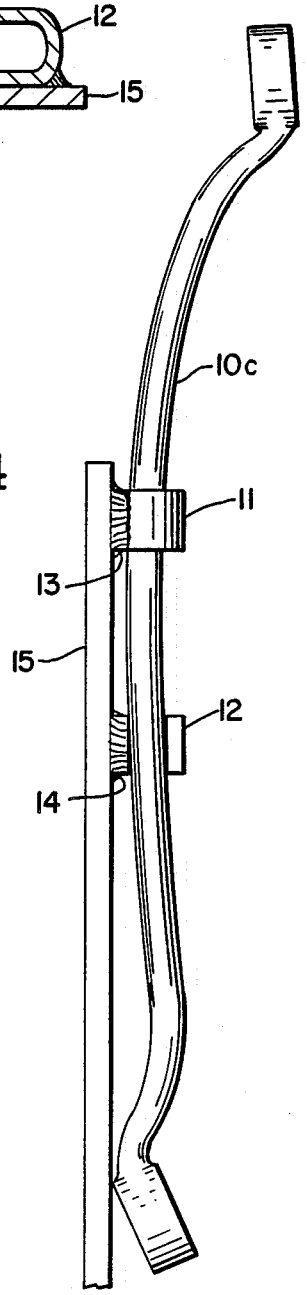
FIG. 4 is a side view of my invention while in use with a curved wrench.

Since some wrenches are curved, the lower legs 13 and 14 of the U-shaped members 11 and 12, respectively, are sufficiently thick that a curved wrench **10*c* will be held by the two U-shaped members 11 and 12 notwithstanding the presence of strip 15, as shown in FIG. 4. Therefore, if the wrench is not flat, my extension will still correctly position the wrench. The wrenches 10 and 10*c* make a snug fit in U-shaped members 11 and 12**.

Figure 2:
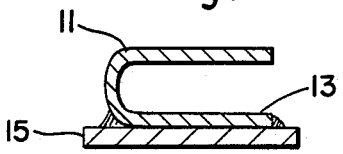
FIG. 2 is a cross-sectional view taken along line 2—2 of FIG. 1.
Figure 3:
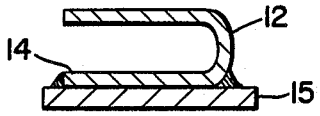
FIG. 3 is a cross-sectional view taken along line 3—3 of FIG. 1.

With the invention as shown in FIGS. 1–3 the extension member 15 enables the user to greatly increase the torque applied by the wrench to tighten a nut. If it is desired to use my device to loosen a nut the device of FIG. 1 is inverted; that is the parts 11 and 12 face downwardly instead of upwardly as shown in FIG. 1, in which case the device will increase the torque of the wrench.

My device will receive a wide range of sizes of wrenches, and the various sizes may be quickly and easily slipped in and out of my device.

The following table gives some design details for various extensions in different sizes, and embodying the invention.

| Wrench size | Wrench extension | Holding stress points |
|---|---|---|
| 3/8 to 1/2 | 7 inches long | 1½ inch apart |
| 9/16 to 5/8 | 10 inches long | 2 inches apart |
| 11/16 to 3/4 | 12 inches long | 3 inches apart |
| 7/8 to 1 1/8 | 15 inches long | 5 inches apart |
| rest of larger wrenches | 24 inches long | 8 inches apart |

In the above table, the column "wrench size" is the size of the nut which the wrench fits. The column "wrench extension" is the overall length of strip 15 (with handle 16) and the column "holding stress points" is the distance between U-shaped members 11 and 12.

I claim to have invented:

1. An extension device for increasing the torque applied to a wrench, comprising in combination:

an elongated bar having first and second ends, said bar having a handle at said first end of said bar, a first spacer element carried by said bar and mounted adjacent said second end of said bar and extending across said bar in a direction transverse to the direction of elongation of said bar, said first spacer element comprising means for spacing a wrench away from said bar, said first spacer element having at least one end, a second spacer element carried by said bar and mounted further from said second end of said bar than said first spacer element and extending across said bar in a direction generally parallel to said first spacer element, said second spacer element comprising means for spacing a wrench away from said bar, said second spacer element having at least one end, first force applying means connected to an end of said first spacer element and extending away from said first spacer element in a direction generally away from said bar for applying a force to a wrench, said first force applying means and said first spacer element defining a slot having an open end through which a wrench may be inserted into said slot, and second force applying means connected to an end of said second spacer element and extending away from said second spacer element in a direction generally away from said bar for applying a force to a wrench, said second force applying means and said second spacer element defining a second slot having an open end through which a wrench may be inserted into said slot, each of said open ends facing in a direction opposite to the direction that the other open end faces, so that the first and second force applying means comprise means for applying a torque to a wrench located in said slots.

* * * * *